US006666624B2

(12) United States Patent
Wetch

(10) Patent No.: US 6,666,624 B2
(45) Date of Patent: Dec. 23, 2003

(54) FLOATING, MODULAR DEEPWATER PLATFORM AND METHOD OF DEPLOYMENT

(75) Inventor: Stephen B. Wetch, Sugar Land, TX (US)

(73) Assignee: Union Oil Company of California, El Segundo, CA (US)

( * ) Notice: Subject to any disclaimer, the term of this patent is extended or adjusted under 35 U.S.C. 154(b) by 0 days.

(21) Appl. No.: 09/923,685

(22) Filed: Aug. 7, 2001

(65) Prior Publication Data

US 2003/0031517 A1 Feb. 13, 2003

(51) Int. Cl.[7] ..... B63B 35/44; E02B 17/00

(52) U.S. Cl. ..... 405/205; 405/195.1; 405/203; 405/223.1; 114/264; 114/267

(58) Field of Search ..... 405/195.1, 203–207, 405/223.1, 224, 196; 114/230, 263–267

(56) References Cited

U.S. PATENT DOCUMENTS

| | | | | |
|---|---|---|---|---|
| 3,433,024 A | | 3/1969 | Diamond et al. | |
| 3,986,471 A | | 10/1976 | Haselton | 114/5 D |
| 4,167,148 A | | 9/1979 | Fayren | 114/265 |
| 4,266,887 A | * | 5/1981 | Corder | 405/224 X |
| 4,422,803 A | | 12/1983 | Wetmore | 405/204 |
| 4,511,288 A | | 4/1985 | Wetmore | 405/217 |
| 4,674,918 A | * | 6/1987 | Kalpins | 405/224 |
| 4,823,719 A | | 4/1989 | Sarwe | 114/126 |
| 4,907,912 A | * | 3/1990 | Smith | 405/207 X |
| 4,913,238 A | | 4/1990 | Danazcko et al. | 166/350 |
| 4,995,762 A | | 2/1991 | Goldman | 405/195 |
| 5,403,124 A | | 4/1995 | Kocaman et al. | 405/209 |
| 5,609,442 A | | 3/1997 | Horton | 405/205 |
| 5,707,178 A | * | 1/1998 | Srinivasan | 405/223.1 |
| 5,791,819 A | | 8/1998 | Christiansen | 405/224 |
| 6,024,040 A | | 2/2000 | Thomas | 114/264 |
| 6,139,224 A | | 10/2000 | Michel et al. | 405/224 |
| 6,196,767 B1 | * | 3/2001 | Thomas | 405/203 |
| 6,227,137 B1 | | 5/2001 | Allen et al. | 114/264 |
| 6,244,785 B1 | | 6/2001 | Richter et al. | 405/195.1 |
| 6,263,824 B1 | | 7/2001 | Balint et al. | 114/264 |
| 6,299,383 B1 | | 10/2001 | Finn et al. | 405/209 |
| 6,309,141 B1 | | 10/2001 | Cox et al. | 405/224 |
| 6,340,272 B1 | | 1/2002 | Runge et al. | 405/203 |

FOREIGN PATENT DOCUMENTS

| | | | | |
|---|---|---|---|---|
| GB | 2207892 | * | 2/1989 | 114/265 |
| JP | 59149887 | * | 8/1984 | 114/124 |
| WO | WO 02/00496 | | 1/2002 | |

OTHER PUBLICATIONS

"A Semisubmersible for All Seasons," *WorldOil.com*, vol. 222, pp. 1–2, Apr. 2001.

Srinivasan, N., "Tension Base TLP Can Support Development in 4,000 FT Depths," *Offshore*, Mar. 1995, pp. 49, 50, 65 and 69.

* cited by examiner

*Primary Examiner*—Jong-Suk (James) Lee
(74) *Attorney, Agent, or Firm*—Yale S. Pinkle; Gregory F. Wirzbicki

(57) ABSTRACT

A floating platform for use in a body of water comprises an uppermost buoyant and ballastable hull partially submerged in the water without contacting the floor of the body of water and usually without being moored to the floor of the body of water. The bottom of the uppermost hull is attached to the top of a lower buoyant and ballastable hull after the lower hull has been completely submerged in the water and anchored to the floor of the body of water with flexible moorings.

48 Claims, 5 Drawing Sheets

FLOATING, MODULAR DEEPWATER PLATFORM AND METHOD OF DEPLOYMENT

BACKGROUND OF INVENTION

This invention relates generally to platforms from which offshore operations, such as petroleum drilling and production, can be carried out and methods for installing or deploying these offshore platforms. The invention is particularly concerned with (1) methods for deploying, normally in relatively deepwater, floating platforms comprising two or more separately fabricated modules or structures and (2) the resulting platforms whose low heave, pitch and roll motions enable them to support surface wellhead equipment.

As hydrocarbon reserves decline, the search for oil and gas has moved offshore into increasingly deeper waters where economic considerations and physical limitations frequently militate against the use of platforms supported on the ocean or sea floor. Thus, most offshore drilling and production in deep water is conducted from floating platforms that support the drill rig, derrick, and associated drilling and production equipment. The three types of floating platforms that see the most use in deepwater are semisubmersible platforms, tension leg platforms (TLPs), and spars.

Semisubmersible floating platforms typically consist of a flotation hull usually comprising four or more large diameter vertical columns supported on two or more horizontal pontoons. The columns extend upward from the pontoons and support a platform deck. The flotation hull, when deballasted, allows the platform to be floated to the drill site where the hull is ballasted with seawater to submerge it such that the deck remains above the water surface. The platform is held in position by moorings lines anchored to the sea floor. Partially submerging the hull beneath the water surface reduces the effect of environmental forces, such as wind and waves, and results in a relatively stable work deck. Although the semisubmersible platform is stable for most drilling operations, it still exhibits a relatively large heave response to the environment that makes the use of surface wellheads (wellheads located above the water surface) undesirable because of the complexity and cost of riser tensioners and other clearance systems required to permit relative movement between the riser pipes and platform. Instead, the wellheads are typically located on the seafloor, and relatively complex and costly subsea equipment is used to produce hydrocarbons. However, the cost of accessing the wellheads for servicing and workovers becomes more difficult and costly as the water depth increases, thereby making the use of conventional semisubmersibles in deep water somewhat undesirable.

Tension leg platforms (TLPs) are also used to produce hydrocarbons in deep water. These platforms are moored to the ocean floor using semirigid or axially stiff (not axially flexible), substantially vertical tethers or tendons (usually a series of interconnected tubulars). The TLP platform is comprised of a deck and hull similar in configuration and construction to the semisubmersible platform. The hull provides excess buoyancy to support the deck and to tension the tethers and production risers. The deck supports drilling and production operations. The use of axially stiff tethers tensioned by the excess buoyancy of the hull to moor the platform tends to substantially eliminate heave, roll and pitch motions, thereby permitting the use of surface wellheads and all the benefits that accompany their use.

However, heave restraining the entire platform, including the drilling rig, crew quarters and equipment, requires a substantial amount of additional buoyancy and tether steel, which in turn substantially increases the cost of the TLP.

Another type of floating structure used in offshore drilling and production operations is a spar. This type of structure is typically an elongated, vertically disposed, cylindrical hull that is buoyant at the top and ballasted at its base. The hull is anchored to the sea floor by flexible taut or catenary mooring lines. Although the upper portion of a spar's hull is buoyant, it is normally not ballastable. Substantially all the ballast is located in the lower portion of the hull and causes the spar to have a very deep draft, which tends to reduce heave, pitch and roll motions. The main problem with the use of spar platforms is the difficulty in deploying them in deep water. The elongated hull must be towed to the desired offshore location on its side and then upended in the water so it can be vertically oriented. After it is upended, its deck and associated equipment must be placed on the top of the hull. Both of these operations require the use of a large floating crane and other equipment at the offshore location, thus making the installation a complex and expensive endeavor.

It is clear from the above discussion that the three types of platforms commonly used in deepwater exploration and production have significant disadvantages. Thus, there exists a need for other platform designs that result in structures that not only possess low heave, pitch and roll motions but are also relatively inexpensive and simple to build and easy to deploy in relatively deep offshore waters.

SUMMARY OF THE INVENTION

In accordance with the invention, it has now been found that a floating platform or other apparatus can be more easily constructed and deployed in a body of water if it is comprised of two or more buoyant and ballastable structures or hulls that are separately fabricated in conventional shipyards or other fabrication facilities and then individually floated to the desired location in the body of water. Here, the lower structure is anchored to the floor of the body of water, usually using flexible and substantially non-vertical mooring lines, and then ballasted down until completely submerged. After the lower buoyant and ballastable structure has been anchored and completely submerged in the body of water, an upper structure is floated over the lower structure, and both structures are selectively ballasted and/or deballasted until the top of the lower structure mates with the bottom of the upper structure under the water surface to form a floating apparatus that can support a deck or platform from which offshore operations are conducted. The lower structure remains completely submerged in the water without touching the bottom of the body of water.

The resulting floating apparatus comprises an uppermost buoyant and ballastable structure partially submerged in the water without contacting the floor of the body of water and a lower buoyant and ballastable structure, which typically has a height greater than about 50% of the height of the uppermost structure, that is completely submerged in the water without contacting the floor of the body of water. The bottom of the uppermost structure is fixedly mated to the top of the lower structure, and the lower structure is anchored to the floor of the body of water, usually with flexible and non-vertical mooring lines. The uppermost structure typically supports a deck from which drilling, production, and workover operations are carried out. The relatively deep draft, usually greater than about 150 feet, of the combined structures coupled with the moorings used on the lower structure results in substantially reduced heave, pitch and roll motions and thereby makes it feasible to employ surface wellheads. Normally, it is not necessary for obtaining the desired heave, pitch and roll responses of the combined structures to anchor the uppermost structure to the floor of the body of water with moorings of any kind. However, the uppermost structure may contain winches or other devices for tensioning the mooring lines used to anchor the lower structure.

In some instances, especially when it is desired to provide oil and/or gas storage capabilities to the invention, more than two separate buoyant and ballastable structures can be utilized in the floating apparatus. Such a system can be constructed by fabricating the additional structure or structures in the shipyard and floating them to the desired offshore location where they are selectively ballasted and/or deballasted as described above such that the top of one structure mates with the bottom of another. The resulting apparatus will then comprise two or more structures completely submerged in the water with the uppermost structure only partially submerged and supporting a deck from which offshore operations can be conducted. Typically, only the lowermost structure will be anchored to the floor of the body of water, usually with flexible, non-vertical mooring lines. In this apparatus, the lowermost structure(s) can be designed to store oil and/or gas, and all of the structures combined may have a draft of as much as about 150 to 400 feet.

The apparatus and method of the invention have significant advantages over conventional offshore platforms and installation methods. The individual modules or structures comprising the apparatus of the invention can be made in simple shapes (e.g., square and rectangle boxes) and in relatively small sizes (e.g., heights usually less than about 150 feet) that allow the structures to be fabricated in conventional shipyards with conventional equipment. The uppermost structure can be built in the shipyard with the deck and associated drilling, production, and/or workover equipment preinstalled so that vertical lifting devices are not needed offshore to fit the platform and its equipment to the supporting structure. Furthermore, since the individual modules or structures are buoyant and ballastable, they can be towed to the desired offshore site without using barges and can be fixed together without the need for heavy lift equipment. Finally, the heave, pitch and roll resistance of the combined modules or structures allows the use of surface completions and wellheads.

BRIEF DESCRIPTION OF THE DRAWINGS

All identical reference numerals in the figures of the drawings refer to the same or similar elements or features.

DETAILED DESCRIPTION OF THE INVENTION

Figure 1:
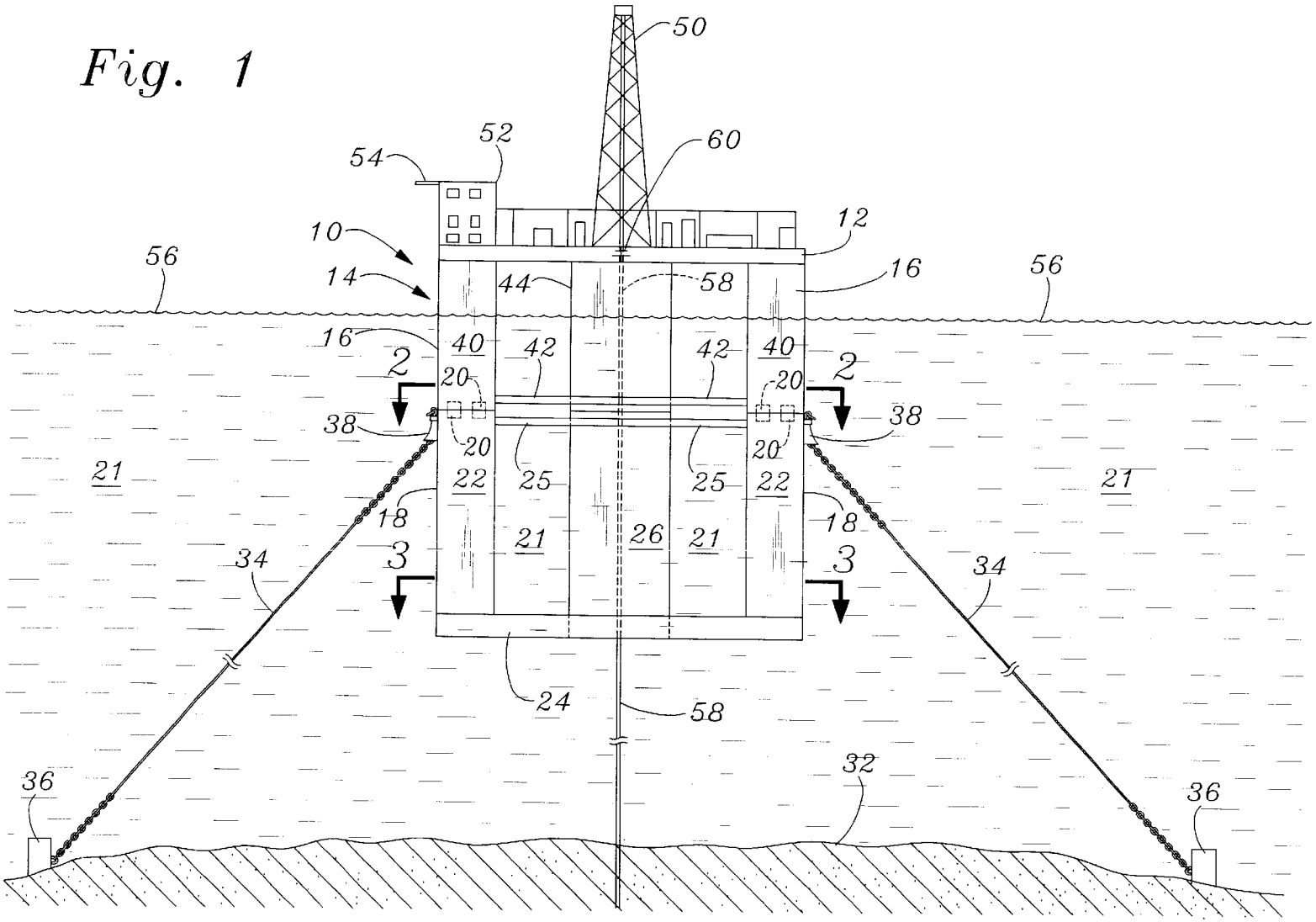
FIG. 1 in the drawings is a side elevation view of an embodiment of the apparatus of the invention containing two buoyant and ballastable modules or hulls attached to one another such that one is on top the other.
Figure 3:
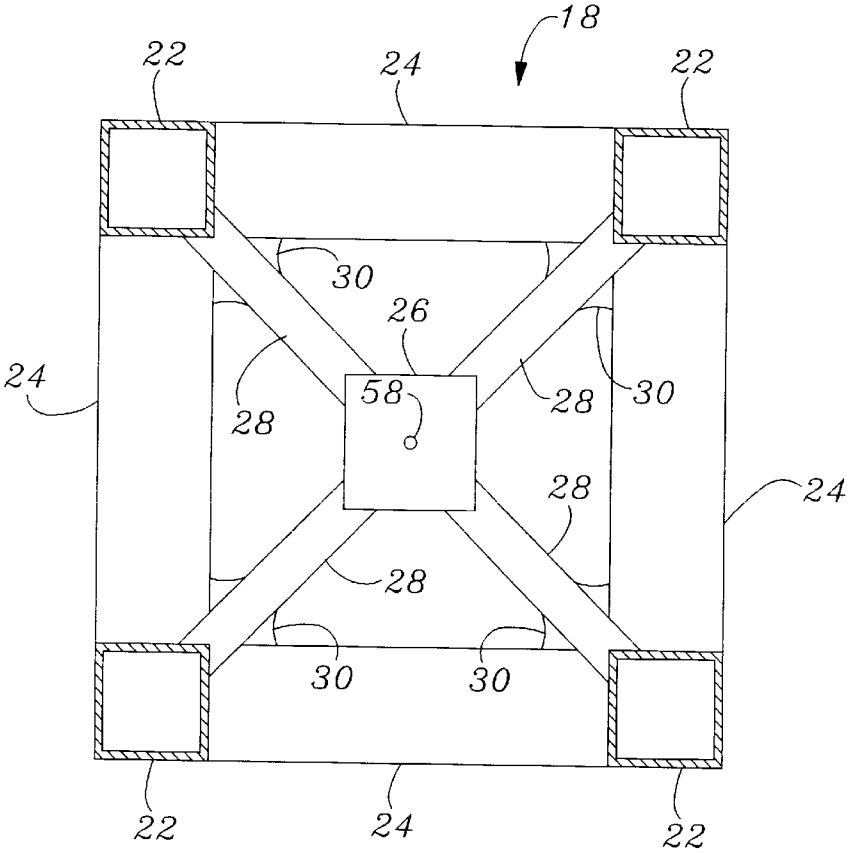
FIG. 3 is a plan view of the apparatus of the invention shown in FIG. 1 taken along the line 3—3.
Figure 2:
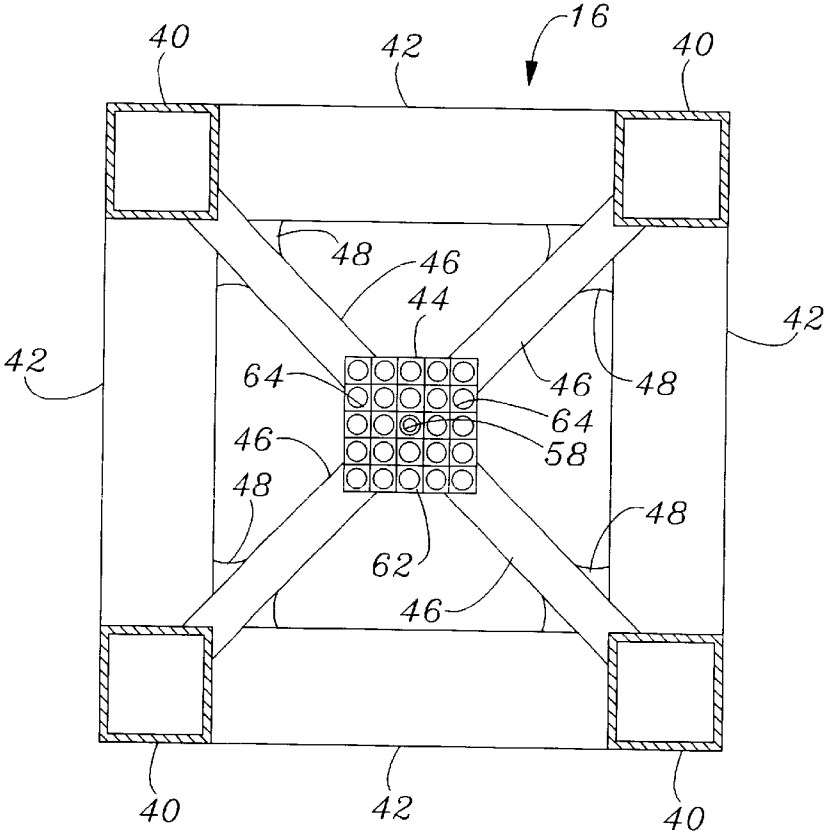
FIG. 2 is a plan view of the apparatus of the invention shown in FIG. 1 taken along the line 2—2.

FIGS. 1–3 in the drawings illustrate one embodiment of the apparatus of the invention, an offshore platform 10 for use in conducting drilling, production and/or workover operations in relatively deep water, e.g. water having a depth of between about 1,500 and 13,000 feet. It will be understood, however, that the apparatus of the invention is also suitable for other uses that require low motion support offshore in a body of water having a depth as low as 400 to 800 feet, but typically above 1,000 feet, such as supporting an industrial plant, storing supplies, accommodating personnel, landing aircraft and the like.

The platform 10 comprises deck 12 supported by a floating modular structure 14 that is comprised of upper hull structure 16 and lower hull structure 18. The bottom of upper hull 16 is attached to and fixedly mated with the top of lower hull 18 by hull securing devices 20. These securing devices may be any type of mechanical connector conventionally used to join large tubulars either above or below water. Examples of such connectors include self-locking pipe connectors, marine riser connectors, and hydraulic type connectors. In lieu of or in addition to mechanical connectors, the two hulls can be fixedly joined by permanent welds between the bottom of upper hull 16 and the top of lower hull 18, or by net compression supplied by buoyancy control between the two adjoining hulls as will be described in more detail hereinafter. The modular structure 14 floats in body of water 21, which, for example, may be an ocean, sea, bay or lake.

Lower hull 18 (see FIGS. 1 and 3) is comprised of four vertical lower hull columns 22, four lower hull bottom pontoons 24 and, in some cases, four lower hull top pontoons 25. The hull also contains a lower hull central column or well bay structure 26 that is connected to columns 22 by lower hull diagonal tubulars 28 and lower hull gusset plates 30. The well bay serves to shield any risers supported by platform 10 from the wave action of the water 21 or other environmental forces. If, however, it is desirable to design lower hull 18 to be transparent to the horizontal movement of water 21, the central column or well bay 26 can be eliminated from the lower hull or replaced by a conventional open truss framework of tubulars.

Lower hull 18 is anchored to the floor 32 of body of water 21 by mooring lines 34 and piles or other anchoring devices 36 to prevent large horizontal movements of modular structure 14. Normally, sets of two, three or four mooring lines are attached to each of the four lower hull columns 22. The mooring lines 34 may be taut, as shown in FIG. 1, or catenary and usually comprise a combination of steel chain and wire or synthetic rope as shown in FIG. 1. These mooring lines are flexible and usually oriented in a substantially non-vertical position, usually from about 20 degrees to about 55 degrees from the vertical position, depending on the depth of body of water 21. These characteristics distinguish them from the tendons used to anchor TLPs, which tendons are typically a series of interconnected semirigid tubulars oriented in a substantially vertical position. The mooring lines 34 are attached to the lower hull 18 using fairlead and chain stopper assemblies 38. Although flexible mooring lines are normally used to anchor the lower hull to the floor 32 of body of water 21, tendons can be used if desired.

The upper hull 16 (see FIGS. 1 and 2) is comprised of four vertical upper hull columns 40 and, in some cases, four upper hull pontoons 42. The upper hull also contains an upper hull central column or well bay 44, that is connected to columns 40 by upper hull diagonal tubulars 46 and upper hull gusset plates 48. The upper hull well bay 44 serves to shield any risers supported by the platform 10 from the wave action of the water 21 or other environmental forces and, if its bottom is closed or plugged, can also be used for increased buoyancy of the upper hull during deployment of modular structure 14 as described in more detail hereinafter. If increased buoyancy is not needed, upper hull well bay 44 can be perforated—instead of continuous as shown in FIG. 1—to decrease its resistance to water but still protect the risers from wave action.

The combination of upper hull 16 stacked on top of and fixedly attached to lower hull 18 forms floating modular structure 14, which in turn supports deck 12. In the embodiment of the invention shown in FIG. 1, deck 12 is used to support conventional oil and gas drilling and production equipment, such as derrick 50, crew quarters 52 and heliport 54. As pointed out above, however, deck 12 can be used to support other operations besides oil and gas drilling, production and workover. Any operation requiring support in an offshore environment can be carried out on deck 12.

As shown in FIG. 1, the height of upper hull 16 is less than the height of lower hull 18. Although this is the usual case, the heights of the two hulls may be the same or the height of the upper hull may be greater than that of the lower hull. Normally, the height of each individual hull ranges from about 80 to about 150 feet, preferably between about 100 and about 125 feet. The height of upper hull 16 is usually kept under about 125 feet to facilitate its fabrication in dry dock and the attachment of deck 12. Such heights make it possible to build the individual hulls in conventional size shipyards or other fabrication facilities without the need for employing extra large construction equipment, such as oversized cranes and dry docks.

Although upper and lower hulls 16 and 18 are depicted, respectively, in FIGS. 2 and 3 as being in the shape of a square box, i.e., each hull having the same length as width, it will be understood that the width and length of the same hull and each individual hull can be different. The width of each hull typically ranges between about 90 and about 280 feet, usually from about 120 to about 250 feet. If the length is greater than the width, i.e., the hull is rectangular in shape, the length will usually exceed the width by between about 10 and 20 percent.

It will be understood that, although upper hull 16 and lower hull 18 typically each have a quadrilateral shape and contain four structural columns, each hull may have other shapes and contain a different number of structural columns. For example, each hull can take the shape of a triangle and contain three columns, a cylinder, which is itself a single column, or a hexagon and contain six columns. Furthermore, the shape and number of structural columns possessed by one hull may be different from the shape and number of structural columns possessed by another. For example, the upper hull could be triangular in shape and contain three structural columns while the lower hull is cylindrical or vice versa. Likewise, although upper hull columns 40 and lower hull columns 22 are depicted in FIGS. 1–3 as having a square cross sectional shape that is uniform in the vertical direction, they may have different cross sectional shapes, such as triangular, rectangular or circular, and the cross sectional shape may vary in the vertical direction.

Each hull 16 and 18 is designed to be both buoyant and ballastable and therefore contains ballast compartments or tanks, not shown in the drawings. These ballast compartments are usually located in lower hull bottom pontoons 24, in upper hull pontoons 42 if present, in lower hull columns 22 and in upper hull columns 40, thereby giving each hull adjustable ballast capability. Obviously, each hull contains conventional equipment associated with the ballast compartments, such as ballast pumps, manifolds, valves and piping, which allow ballast, typically seawater, to be pumped in or out of the ballast compartments to adjust the position of each hull in the water 21.

Since it is the buoyancy of modular structure 14 that supports deck 12 and its payload of associated equipment, the size of the columns and pontoons will typically depend on the size of the payload. Normally, the width and length of the lower hull columns 22 and the upper hull columns 40 range between about 20 and 60 feet, while the height of the columns usually is between about 70 and 120 feet. The width of lower hull bottom pontoons 24, lower hull top pontoons 25, and upper hull pontoons 42 is typically the same as the width of columns 22 and 40 while the length varies from about 50 to about 230 feet. The pitch and roll motions of modular structure 14 can be decreased by increasing the length of the lower hull bottom pontoons 24 and upper hull pontoons 42 and thereby increasing the distance between the lower hull columns 22 and upper hull columns 40, respectively. Typically, the height of lower hull bottom pontoons 24 is greater than that of lower hull top pontoons 25 and upper hull pontoons 42 and ranges between about 20 and 60 feet. However, it should be understood that it may not be necessary to utilize pontoons 25 and/or 42 in the modular structure 14 as is discussed in more detail below, and they may be eliminated altogether.

The upper and lower hulls 16 and 18 are usually individually ballasted so that modular structure 14 floats in body of water 21 such that the bottom of deck 12 is between about 20 and 60 feet above the water surface 56 and the modular structure 14 has a draft between about 100 and 300 feet, usually greater than about 150 feet and less than about 250 feet. A draft of this depth reduces the heave response of platform 10 to such a level that surface well completions can be utilized. Thus, platform 10 is shown in FIG. 1 to contain a riser 58 extending upward from water floor 32 through the bottom of deck 12 and terminating at wellhead 60. Typically, platform 10 is designed to support between about 4 and 30 risers and associated surface wellheads.

As shown in FIG. 2, upper hull 16 contains guide frame 62 comprised of guidance sleeves 64. Each riser supported by platform 10 passes through a guidance sleeve in the guide frame, which sleeve supplies lateral support to its riser. Each sleeve is usually between about 2 to 3 feet high and is typically formed by welding the small end of a cone-shaped sleeve onto each end of a short cylinder. Although not shown in FIGS. 1–3, the upper hull 16 usually contains 3 or 4 guidance frames spaced equally apart, while lower hull 18 typically contains 2 or 3 evenly spaced frames.

The use of a modular floating structure comprised of separate hulls disposed beneath one another as a platform for conducting offshore oil and gas operations has a number of advantages. It allows the individual hulls or modules to be separately fabricated, usually of steel, in small enough sizes and shapes that they can be made in conventional size shipyards with conventional equipment, thereby reducing manufacturing costs. Moreover, by pre-installing the deck and its associated equipment on the top of one of the modules during fabrication in dry dock, the need to employ cranes and other expensive equipment for an offshore installation is eliminated. Also, since the individually fabricated modules or hulls are buoyant and ballastable, they can be floated rather than barged to the desired offshore location. Finally, combining the modules offshore into a much larger structure results in a draft sufficiently deep that heave motions are reduced to a level that allows the use of surface wellheads, further decreasing the cost of producing oil and/or gas offshore.

Figure 4:
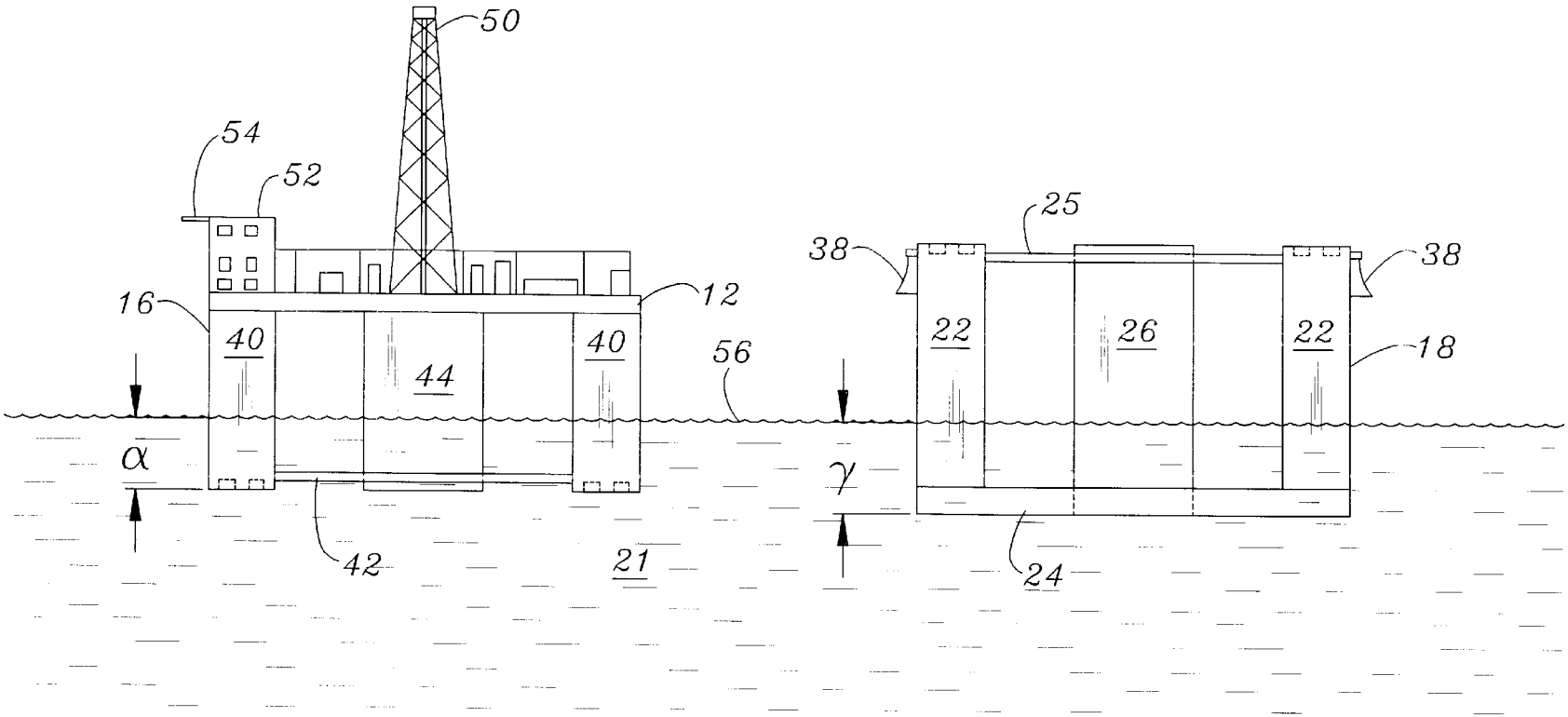
FIG. 4 is a side elevation view showing the upper and lower buoyant and ballastable modules or hulls of FIG. 1 floating separately in a body of water at a preselected offshore location before they are aligned, ballasted and mated to form the apparatus of the invention shown in FIG. 1.
Figure 5:
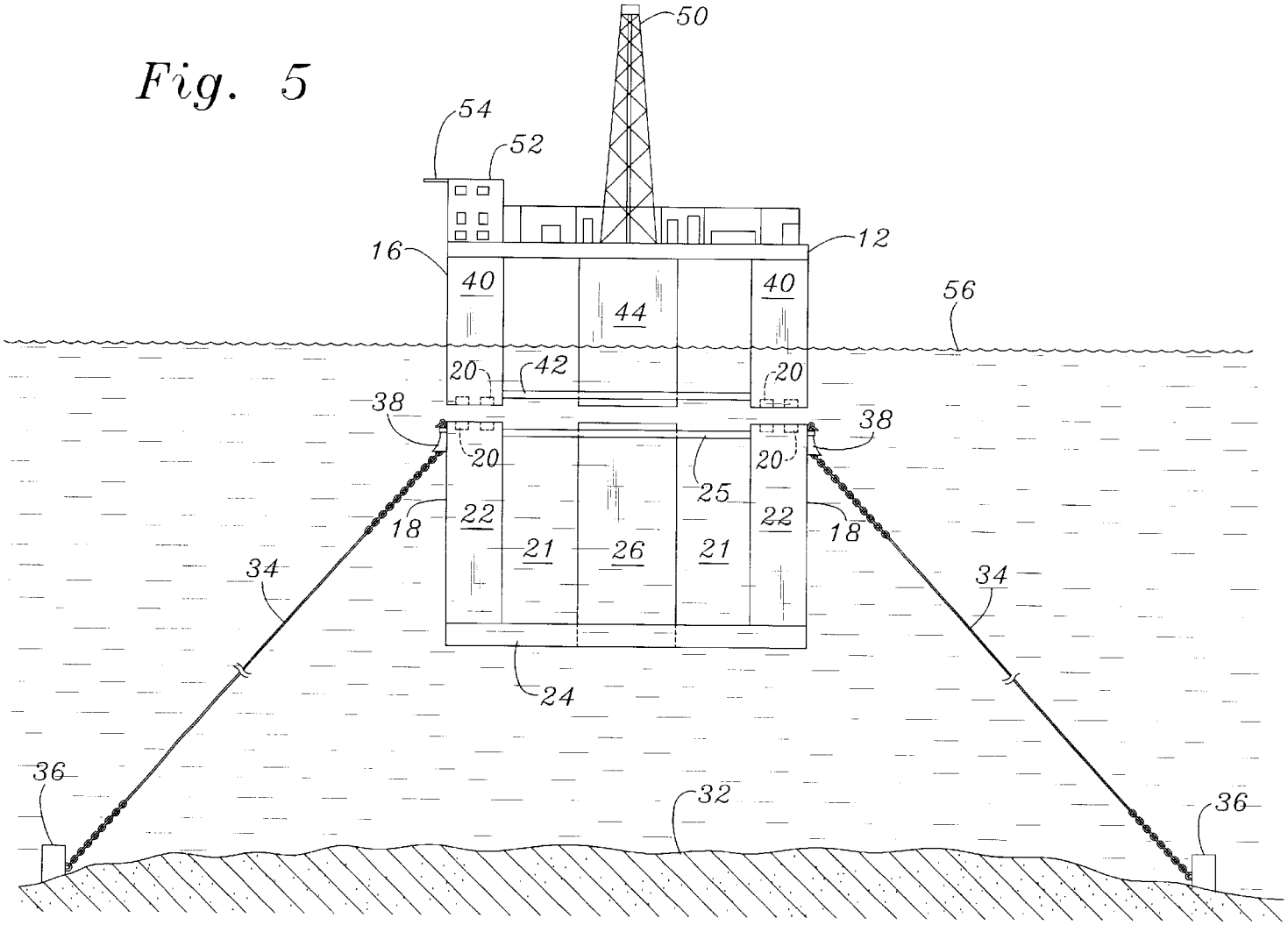
FIG. 5 is a side elevation view showing the upper and lower buoyant and ballastable modules or hulls of FIG. 1 after the lower buoyant and ballastable module has been anchored or moored to the floor of the body of water and the upper module aligned thereover but before the upper and lower modules have been mated to form the apparatus of the invention shown in FIG. 1.

FIGS. 4 and 5 illustrate one embodiment of the method of the invention. After upper and lower hulls 16 and 18 have been fabricated in the same or separate shipyards and the deck 12 with its associated equipment 50, 52, and 54 has been installed on top of hull 16 in the shipyard, the two hulls are individually floated out of the shipyard and separately towed by boat in a low-draft position to the desired assembly or deployment site in body of water 21. FIG. 4 shows the two hulls in their low-draft positions $\alpha$ and $\gamma$ at the desired offshore assembly location after the towboats have departed. During the towing process, upper hull columns 40, upper hull pontoons 42, and upper hull well bay 44 provide the buoyancy required to float upper hull 16 (with deck 12 attached) in its low-draft position $\alpha$ to the desired offshore location. If the weight of deck 12 and its associated equipment is sufficiently low, it may be feasible to design the hull 16 without pontoons 42 and the buoyancy they provide. If the pontoons are not included in the hull, the well bay can be tied to upper hull columns 40 with a conventional open truss structure of tubulars not shown in the drawing.

The buoyancy required for floating lower hull 18 is provided by lower hull columns 22, lower hull bottom pontoons 24, and lower hull top pontoons 25. If the added buoyancy that pontoons 25 provide is not needed, they can be eliminated and replaced with a conventional open truss structure. Such an open structure has the advantage of being transparent to the horizontal movement of water 21 and therefore tends to minimize drag response induced by wave energy and water current.

Once the upper and lower hulls arrive at the desired offshore location, deployment of platform 10 is begun, as shown in FIG. 5. Normally, the first step in deployment is to ballast down the lower hull 18 until its top is near the water surface 56, but far enough above the surface so that workers can stand and work on the top of the hull without being endangered by water and environmental forces. Next, the lower hull 18 is attached to mooring lines 34. Prior to floating the hulls to the desired offshore location, one end of each mooring line is attached to a pile or other anchoring device 36 sunk into the floor 32 of body of water 21. The other end of each mooring line is attached to the end of a lighter weight messenger line, and the mooring line is left lying on the floor 32 of the body of water. The other end of each messenger line is attached to a buoy or buoyant can, not shown in FIG. 5, floating at the water surface 56. The messenger lines are then used to attach the mooring lines to the hull by pulling them into the fairleads 38 using winches or other equipment not shown in the figure. Stoppers above the fairleads hold the mooring lines in place. During the attachment process the hull 18 is pulled down further into the water and the mooring lines are overtensioned by the buoyant forces on the hull.

After the mooring lines have been attached to lower hull 18 and overtensioned, the hull is ballasted down further, usually by pumping water 21 into ballast compartments located in lower hull columns 22 and lower hull bottom pontoons 24, until the lower hull is completely submerged in body of water 21 as shown in FIG. 5 and the tension on the mooring lines is decreased to the desired value.

Upper hull 16, which carries deck 12, is floated over and aligned with completely submerged lower hull 18 as shown in FIG. 5. The upper hull 16 is then ballasted down by pumping water 21 into ballast compartments located in upper hull columns 40 and upper hull pontoons 42, and the bottom used to prevent water from entering upper well bay 44, thereby providing extra buoyancy during the towing of the upper hull, is removed. Enough ballast is added so that the bottom surfaces of the upper hull columns 40 contact and mate with the respective upper surfaces of the lower hull columns 22, usually such that there are no vertical gaps between the columns. In order to obtain proper mating between the surfaces, it may be necessary to selectively and separately ballast and deballast each hull.

Once the upper hull 16 and lower hull 18 are mated, they are normally attached to each other and held together with mechanical locking devices 20. It is possible, however, to weld the contact surfaces together from the inside of the hulls after they have been mated and thereby dispense with permanent locking devices. Alternatively, the hulls can be held together by buoyancy control to keep them in net compression at all times. If after the two hulls are mated there is slack in the mooring lines, it is taken up, usually by the use of winches mounted on upper hull 16, and the lower hull 18 is slightly deballasted to raise the combined hulls enough to induce the desired tension forces in the mooring lines. The mating of the two hulls completes the installation or deployment process and results in the formation of the apparatus of the invention as shown in FIG. 1.

The resultant platform is now ready for offshore operations including the installation of risers with surface wellheads, such as riser 58 shown in FIG. 1. Normally, the upper hull is supported entirely by the bottom hull, which is held floating in place by mooring lines 34. The draft of the combined hulls is sufficiently deep to significantly reduce heave, pitch and roll motions while the mooring lines control lateral motion. It is normally not necessary to use other types of anchoring devices, such as substantially vertical and axially stiff tendons and risers, on the lower hull. Moreover, the upper hull is typically devoid of mooring lines and tendons. There is no need to directly anchor the upper hull to the floor of the body of water. Its attachment to the lower hull is sufficient to provide it with the required stability.

As can be seen in FIG. 5 the bottom of upper hull 16 is a mirror image of the top of lower hull 18 because both hulls are designed similarly. However, this may not always be the case. For example, upper hull 16 may not contain upper hull pontoons 42 and upper hull well bay 44 may not extend all the way to the bottom of the hull. In fact, it is possible that well bay 44 will extend downward from deck 12 to only about half the height of hull 16. Also, lower hull 18 may not contain lower hull top pontoons 25 or lower hull well bay 26. Regardless of whether the bottom of upper hull 16 and top of lower hull 18 are mirror images of each other, the area encompassed by the periphery of the bottom surface of the upper hull, e.g., the area encompassed by the outer boundaries of FIG. 2, is normally substantially the same as the area encompassed by the top surface of the lower hull, e.g., the area encompassed by the outer boundaries of FIG. 3. However, in some cases the area encompassed by the periphery of the bottom surface of the upper hull may be either larger or smaller than the area encompassed by the top surface of the lower hull.

Figure 6:
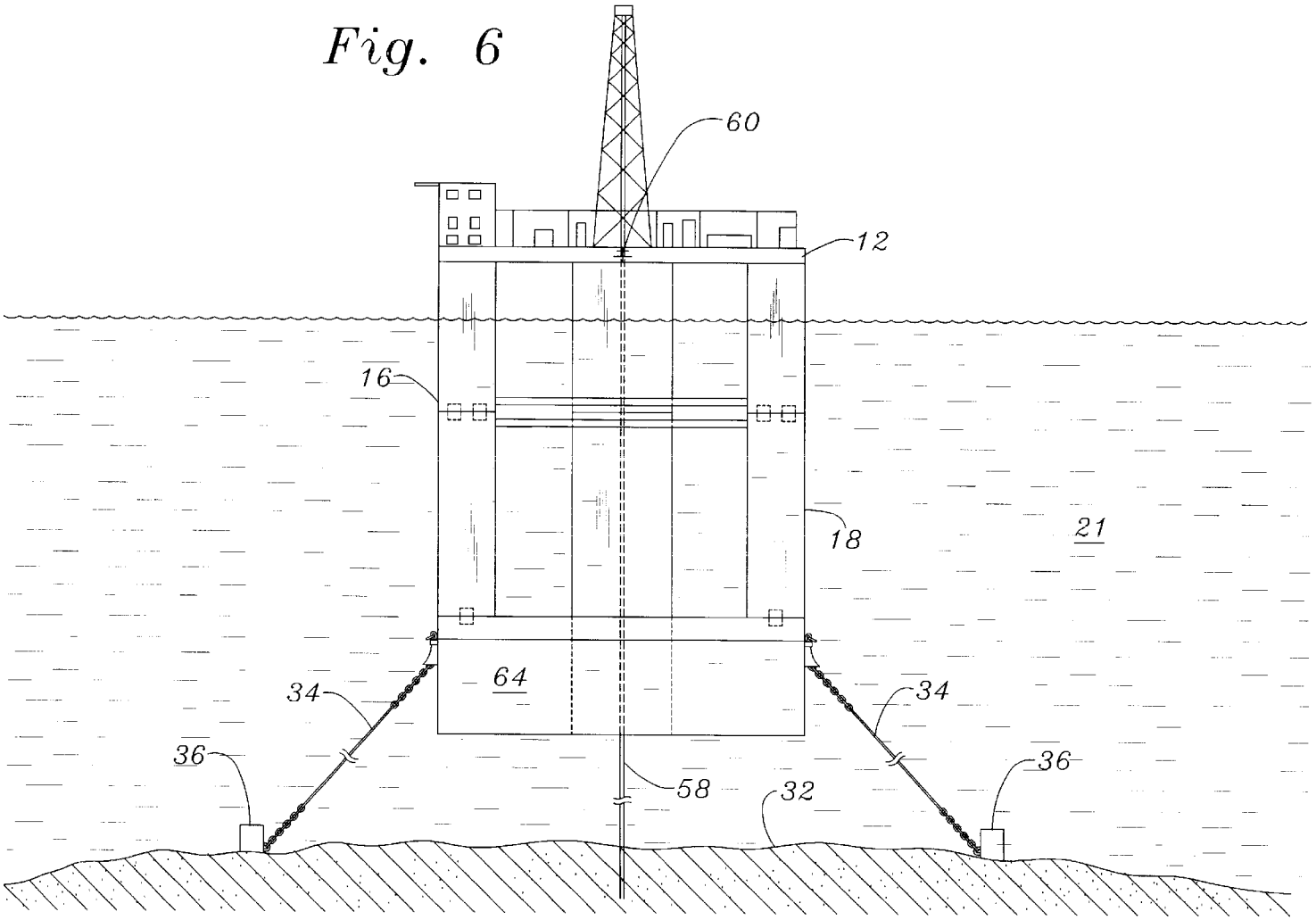
FIG. 6 is a side elevation view of another embodiment of the apparatus of the invention containing three buoyant and ballastable modules or hulls attached to one another such that the upper module is on top of the middle module and the middle module is on top of the lower module.

Another embodiment of the apparatus of the invention is shown in FIG. 6. This embodiment is similar to the one shown in FIG. 1, but contains a third module or hull 64 attached to and disposed below lower hull 18. This hull is usually the same shape as the upper and lower hulls, but instead of containing columns it normally is a box-like structure with the center open to accommodate risers running downward from deck 12 to the floor 32 of the body of water 21. The hull 64 contains multiple compartments, not shown in FIG. 6, that are designed to store oil and/or gas produced through the risers. The draft of this three-module embodiment of the apparatus of the invention is obviously greater than that of the embodiment shown in FIG. 1 and normally ranges from about 200 to about 400 feet.

The embodiment of the apparatus of the invention shown in FIG. 6 is deployed or installed using the method described for the installation of the embodiment shown in FIG. 1 and described with respect to FIGS. 4 and 5. Hull 64 is separately built in a shipyard and towed in a low-draft position, as is the upper and lower hulls 16 and 18, respectively, to the desired offshore location. Then hull 64, instead of hull 18, is attached to mooring lines 34 as described previously. After hull 64 has been ballasted down and completely submerged in water 21, the lower hull 18 is positioned and aligned over the hull 64 and then ballasted and/or deballasted until its bottom surface mates with and attaches to the top surface of hull 64. The combination of the two hulls is ballasted down such that the combined structure is fully submerged in water 21. Finally, upper hull 16 is floated over and aligned with the top of lower hull 18 and then mated with the lower hull as described previously with respect to FIG. 5.

The embodiments of the apparatus of the invention shown in FIGS. 1 and 6 are comprised, respectively, of two and three buoyant and ballastable modules or hulls. It will be understood that the apparatus of the invention is not restricted to the use of two or three hulls. Any number of buoyant and ballastable hulls can be used to construct the apparatus of the invention in accordance with the methods of the invention described above. Moreover, the individual hulls can be designed similarly or differently depending on the offshore location and desired use of the apparatus of the invention. In addition, although the embodiment of the invention shown in FIG. 6 contains three modules and is designed to store oil and/or gas in the bottom module 64, it will be understood that oil and/or gas can be stored in an embodiment of the apparatus of the invention containing only two buoyant and ballastable modules. For example, the embodiment of the invention shown in FIG. 6 can be modified by not employing lower hull 18, thereby forming another embodiment of the invention in which the bottom of upper hull 16 is directly attached to the top of hull 64.

Although this invention has been described by reference to several embodiments and to the figures in the drawing, it is evident that many alterations, modifications and variations will be apparent to those skilled in the art in light of the foregoing description. Accordingly, it is intended to embrace within the invention all such alternatives, modifications and variations that fall within the spirit and scope of the appended claims.

I claim:

1. A floating apparatus for use in a body of water, said apparatus comprising:

(a) an uppermost buoyant and ballastable structure partially submerged in said body of water without contacting the floor of said body of water and having a top and a bottom, wherein said uppermost structure is not anchored to the floor of said body of water and comprises a plurality of structural columns; and (b) a lower buoyant and ballastable structure completely submerged in said body of water without contacting the floor of said body of water and having a top and a bottom, said lower structure attached to said uppermost structure such that the bottom of said uppermost structure mates with the top of said lower structure, and wherein said lower structure is anchored to the floor of said body of water with flexible and non-vertical moorings and is devoid of vertical tendons.

2. The apparatus defined by claim 1 wherein said lower buoyant and ballastable structure comprises two or more completely submerged structures stacked on top of one another, and the lowermost of said stacked structures is anchored to the floor of said body of water with flexible and non-vertical moorings.

3. The apparatus defined by claim 2 wherein the lowermost of said stacked structures is designed to store oil and/or gas.

4. The apparatus defined by claim 1 wherein the height of said lower structure is greater than about 50% of the height of said uppermost structure.

5. The apparatus defined by claim 1 wherein the height of said lower structure is greater than the height of said uppermost structure.

6. The apparatus defined by claim 1 wherein the horizontal cross-section of said lower and said uppermost structures is the shape of a square.

7. The apparatus defined by claim 1 wherein the horizontal cross-section of said lower and said uppermost structures is the shape of a rectangle.

8. The apparatus defined by claim 1 wherein said uppermost structure supports a drilling facility.

9. The apparatus defined by claim 1 wherein said uppermost structure supports a production facility.

10. The apparatus defined by claim 1 wherein said uppermost structure supports a workover facility.

11. The apparatus defined by claim 1 devoid of jacking legs.

12. The apparatus defined by claim 1 wherein the bottom surface of said uppermost structure is a substantial mirror image of the top surface of said lower structure.

13. The apparatus defined by claim 1 having a draft between about 150 and about 400 feet.

14. The apparatus defined by claim 1 wherein said lower buoyant and ballastable structure has a quadrilateral shape and comprises (1) two pair of parallel spaced-apart pontoons forming four bottom sections of said structure, and (2) four upstanding structural columns, one each at the four corners where said bottom sections meet.

15. The apparatus defined by claim 14 wherein said uppermost buoyant and ballastable structure has a quadrilateral shape and comprises four structural columns forming the four corners of said structure.

16. The apparatus defined by claim 15 wherein said uppermost buoyant and ballastable structure further comprises an inner column near the center of said structure.

17. The apparatus defined by claim 1 wherein the bottom of said uppermost structure mates with the top of said lower structure such that there is no overlap at the horizontal interface between said bottom and top.

18. The apparatus defined by claim 1 wherein said apparatus is not a spar.

19. The apparatus defined by claim 1 wherein there is no vertical gap between where said uppermost structure mates with said lower structure.

20. A floating apparatus for use in a body of water, said apparatus comprising:

(a) an upper buoyant and ballastable structure partially submerged in said body of water without contacting the floor of said body of water, wherein said upper structure comprises a plurality of structural not anchored to the floor of said body of water with moorings;

(b) a lower buoyant and ballastable structure completely submerged in said body of water without contacting the floor of said body of water, wherein (1) the top of said lower structure is attached to the bottom of said upper structure, (2) said lower structure has a height greater than the height of said upper structure and (3) said lower structure is anchored to the floor of said body of water with flexible and non-vertical moorings; and (c) means for attaching the top of said lower structure to the bottom of said upper structure.

21. The apparatus defined by claim 20 wherein said means for attaching is selected from the group consisting of mechanical connections, welds, and buoyancy control.

22. The apparatus defined by claim 20 having a draft ranging from about 150 to about 250 feet.

23. The apparatus defined by claim 20 wherein the bottom surface of said upper structure is attached to the top surface of said lower structure.

24. The apparatus defined by claim 20 wherein the bottom surface of said upper structure is a substantial mirror image of the top surface of said lower structure.

25. The apparatus defined by claim 20 wherein said upper and lower buoyant and ballastable structures each have a quadrilateral shape and comprise at least four structural columns.

26. A floating apparatus for use in a body of water and having a draft greater than about 150 feet, said apparatus comprising:

(a) an upper buoyant and ballastable structure partially submerged in said body of water without contacting the floor of said body of water and having a top surface and a bottom surface, wherein said upper structure is devoid of moorings; and (b) a lower buoyant and ballastable structure completely submerged in said body of water without contacting the floor of said body of water and having a top surface and a bottom surface, said lower structure attached to said upper structure such that the bottom surface of said upper structure mates with the top surface of said lower structure, wherein said lower structure is anchored to the floor of said body of water with flexible and non-vertical moorings and is devoid of vertical tendons.

27. The apparatus defined by claim 26 devoid of jacking legs.

28. The apparatus defined by claim 26 wherein said upper and lower structures each have a quadrilateral shape and comprise at least four structural columns.

29. A floating apparatus for use in a body of water, said apparatus comprising:

(a) an upper buoyant and ballastable structure partially submerged in said body of water without contacting the floor of said body of water and having a top and a bottom;

(b) a middle buoyant and ballastable structure completely submerged in said body of water without contacting the floor of said body of water and having a top and a bottom, said middle structure attached to said upper structure such that the bottom of said upper structure mates with the top of said middle structure; and (c) a lower buoyant and ballastable structure completely submerged in said body of water without contacting the floor of said body of water and having a top and a bottom, said lower structure attached to said middle structure such that the bottom of said middle structure mates with the top of said lower structure, and wherein said lower structure is anchored to the floor of said body of water with flexible and non-vertical moorings.

30. The apparatus defined by claim 29 wherein said lower structure is designed to store oil and/or gas.

31. The apparatus defined by claim 29 wherein said upper, middle and lower buoyant and ballastable structures each have a quadrilateral shape.

32. A method for deploying in a body of water a floating apparatus comprising an uppermost buoyant and ballastable structure and a lower buoyant and ballastable structure, said method comprising:

(a) floating said lower buoyant and ballastable structure to a desired location in said body of water;

(b) anchoring said lower structure to the floor of said body of water;

(c) after said lower structure has been anchored to the floor of said body of water, ballasting down said lower structure until it is completely submerged in said body of water;

(d) floating said uppermost buoyant and ballastable structure to a location in said body of water above said lower structure; and (e) selectively ballasting and/or deballasting said uppermost structure and/or said lower structure such that the top of said lower structure mates under the surface of said body of water with the bottom of said uppermost structure to form said floating apparatus, wherein during said selective ballasting and/or deballasting said lower structure remains completely submerged in said body of water without contacting the bottom of said body of water and said uppermost structure is partially submerged in said body of water.

33. The method defined by claim 32 wherein the height of said lower structure is greater than about 50% of the height of said uppermost structure.

34. The method defined by claim 32 wherein said uppermost structure is not anchored to the floor of said body of water.

35. The method defined by claim 32 wherein said lower buoyant and ballastable structure comprises two or more submerged structures stacked on top of one another, and the lowermost of said stacked structures is anchored to the floor of said body of water with flexible and non-vertical moorings.

36. The method defined by claim 32 wherein said uppermost and said lower structures each have a quadrilateral shape and comprise at least four columns.

37. The method defined by claim 32 wherein before said lower structure is anchored to the floor of said body of water, said lower structure is ballasted down until its top is near the surface of said body of water.

38. The method defined by claim 32 wherein said floating apparatus consists essentially of two buoyant and ballastable structures.

39. The method defined by claim 32 wherein both said uppermost and said lower structures are selectively ballasted and deballasted in step (e).

40. The method defined by claim 32 wherein said uppermost buoyant and ballastable structure supports a drilling facility, a production facility and/or a workover facility while being floated to said desired location.

41. The method defined by claim 32 wherein said lower structure is anchored to the floor of said body of water with flexible and non-vertical mooring lines.

42. A method for deploying in a body of water a floating apparatus comprising an upper buoyant and ballastable structure and a lower buoyant and ballastable structure, wherein said upper structure supports a deck containing equipment selected from the group consisting of drilling equipment, production equipment and workover equipment, said method comprising:

(a) floating said lower buoyant and ballastable structure to a desired location in said body of water;

(b) anchoring said lower structure to the floor of said body of water with flexible and non-vertical mooring lines;

(c) after said lower structure is anchored to the floor of said body of water, ballasting down said lower structure until it is completely submerged in said body of water;

(d) after said lower structure has been anchored to the floor of said body of water and has been completely submerged in said body of water, floating said upper buoyant and ballastable structure supporting said deck to a location in said body of water above said lower structure; and (e) selectively ballasting and/or deballasting said upper structure and/or said lower structure such that the top of said lower structure mates under the surface of said body of water with the bottom of said upper structure to form said floating apparatus, wherein during said selective ballasting and/or deballasting said lower structure remains completely submerged in said body of water without contacting the bottom of said body of water and said upper structure is partially submerged in said body of water such that said deck is above the surface of said body of water.

43. The method defined by claim 42 wherein both said upper and lower structures are selectively ballasted and deballasted in step (e).

44. The method defined by claim 42 wherein said upper structure is fabricated in dry dock with said deck attached.

45. A method for deploying in a body of water a floating apparatus comprising an upper buoyant and ballastable structure, a middle buoyant and ballastable structure, and a lower buoyant and ballastable structure, said method comprising:

(a) floating said lower buoyant and ballastable structure to a desired location in said body of water;

(b) anchoring said lower structure to the floor of said body of water;

(c) after said lower structure has been anchored to the floor of said body of water, ballasting down said lower structure until it is completely submerged in said body of water;

(d) after said lower structure has been anchored to the floor of said body of water and has been completely submerged in said body of water, floating said middle buoyant and ballastable structure to a location in said body of water above said lower structure;

(e) selectively ballasting and/or deballasting said middle structure and/or said lower structure such that the top of said lower structure mates under the surface of said body of water with the bottom of said middle structure to form a bottom portion of said floating apparatus, wherein said bottom portion is completely submerged in said body of water without contacting the bottom of said body of water;

(f) floating said upper buoyant and ballastable structure to a location in said body of water above said bottom portion of said floating apparatus; and (g) selectively ballasting and/or deballasting said upper structure and/or said bottom portion of said floating apparatus such that the top of said middle structure mates under the surface of said body of water with the bottom of said upper structure to form said floating apparatus, wherein during said selective ballasting and/or deballasting said bottom portion remains completely submerged in said body of water without contacting the bottom of said body of water and said upper structure is partially submerged in said body of water.

46. The method defined by claim 45 wherein before said lower structure is anchored to the floor of said body of water, said lower structure is ballasted down until its top is near the surface of said body of water.

47. The method defined by claim 45 wherein both said middle and said lower structures are selectively ballasted and deballasted in step (e) and both said upper structure and said bottom portion are selectively ballasted and deballasted in step (g).

48. The method defined by claim 45 wherein said upper buoyant and ballastable structure supports drilling equipment, production equipment and/or workover equipment while being floated to said desired location.

* * * * *

UNITED STATES PATENT AND TRADEMARK OFFICE

CERTIFICATE OF CORRECTION

PATENT NO. : 6,666,624 B2
DATED : December 23, 2003
INVENTOR(S) : Stephen B. Wetch It is certified that error appears in the above-identified patent and that said Letters Patent is hereby corrected as shown below:

Column 11,
Line 9, after “structural” and before “not” insert -- columns and is --.

Signed and Sealed this

Fourth Day of May, 2004

JON W. DUDAS
*Acting Director of the United States Patent and Trademark Office*